US007504016B2

(12) United States Patent
Ritter et al.

(10) Patent No.: US 7,504,016 B2
(45) Date of Patent: Mar. 17, 2009

(54) METHOD AND SYSTEM FOR CONTROLLING ADDITION OF POWDERY MATERIALS INTO THE BATH OF AN ELECTROLYSIS CELL FOR THE PRODUCTION OF ALUMINIUM

(75) Inventors: Claude Ritter, Coublevie (FR); Benoît Sulmont, Chambéry (FR)

(73) Assignee: Aluminum Pechiney, Voreppe (FR)

( * ) Notice: Subject to any disclaimer, the term of this patent is extended or adjusted under 35 U.S.C. 154(b) by 309 days.

(21) Appl. No.: 10/574,522

(22) PCT Filed: Sep. 28, 2004

(86) PCT No.: PCT/FR2004/002450

§ 371 (c)(1),
(2), (4) Date: Apr. 3, 2006

(87) PCT Pub. No.: WO2005/033369

PCT Pub. Date: Apr. 14, 2005

(65) Prior Publication Data

US 2007/0034520 A1 Feb. 15, 2007

(30) Foreign Application Priority Data

Oct. 2, 2003 (FR) ..... 03 11546

(51) Int. Cl.
*C25C 3/14* (2006.01)

(52) U.S. Cl. ..... 205/392; 205/372; 205/394; 204/228.8; 204/228.1; 204/228.5; 204/228.6; 204/229.2; 204/230.3; 204/243.1; 204/247.1; 204/247.5

(58) Field of Classification Search ..... 205/372, 205/392, 394; 204/228.8, 228.1, 228.5, 228.6, 204/229.2, 230.3, 243.1, 247.1, 247.5
See application file for complete search history.

(56) References Cited

U.S. PATENT DOCUMENTS

| | | | | |
|---|---|---|---|---|
| 4,417,958 | A * | 11/1983 | Arnason et al. | 205/336 |
| 5,378,326 | A * | 1/1995 | Kumpulainen | 205/392 |
| 5,405,506 | A * | 4/1995 | Kumpulainen | 205/392 |
| 6,436,270 | B1 | 8/2002 | Sander | |
| 2003/0173210 | A1 | 9/2003 | Casinge | |
| 2007/0034520 | A1 | 2/2007 | Ritter et al. | |

FOREIGN PATENT DOCUMENTS

| | | |
|---|---|---|
| DE | 29910803 | 9/1999 |
| DE | 29910803 U1 | 10/1999 |
| RU | 2040593 C1 | 7/1995 |
| RU | 2093611 C1 | 10/1997 |
| SU | 1611992 A1 | 12/1990 |

* cited by examiner

*Primary Examiner*—Bruce F Bell
(74) *Attorney, Agent, or Firm*—Banner & Witcoff, Ltd.

(57) ABSTRACT

This invention relates to a method for controlling additions of powder materials into an electrolytic cell designed for the production of aluminium by fused bath electrolysis. The method according to the invention, which can easily be automated, can be used to maintain monitoring of operation of the feed even during anode effects.

43 Claims, 6 Drawing Sheets

METHOD AND SYSTEM FOR CONTROLLING ADDITION OF POWDERY MATERIALS INTO THE BATH OF AN ELECTROLYSIS CELL FOR THE PRODUCTION OF ALUMINIUM

CROSS REFERENCE TO RELATED APPLICATIONS

This application is §371 National Stage Application of International Application No. PCT/FR04/002450 filed Sept. 28, 2004 which claims priority to French Application No. 0311546 filed Oct. 2, 2003.

BACKGROUND OF THE INVENTION

1. Field of the Invention

The invention relates to the production of aluminium by fused bath electrolysis using the Hall-Héroult process. It is used particularly for controlling additions of powder materials into an electrolyte bath of electrolytic cells.

2. Description of Related Art

The operation of a cell for the production of aluminium by fused bath electrolysis of alumina dissolved in a cryolite based bath causes a permanent change in the composition of the bath. Firstly, alumina is consumed by the electrolysis reactions, and secondly the quantity and composition of the bath are gradually modified by secondary mechanisms such as absorption of cryolite constituents by the walls of the cell or decomposition of fluorinated constituents by anode effects. Consequently, alumina and bath compounds such as cryolite ($Na_3AlF_6$) or aluminium fluoride ($AlF_3$) have to be added regularly in order to stabilise operation parameters of the cell. The purpose of this stabilisation is in particular to achieve the highest possible Faraday efficiency and to prevent anode effects caused by a shortage of alumina in the bath and the accumulation of alumina "sludge" at the bottom of the pots caused by excess alumina.

The alumina and bath compounds are usually added into the bath in the form of a powder. Several methods and devices are known for automatically "feeding" electrolytic cells with powder materials in a regulated manner. For example, the following patent applications in the name of Aluminium Pechiney describe methods for regulating additions of alumina, aluminium fluoride or other: FR 2 749 858 (corresponding to U.S. Pat. No. 6,033,550), FR 2 581 660 (corresponding to U.S. Pat. No. 4,654,129), FR 2 487 386 (corresponding to U.S. Pat. No. 4,431,491), FR 2 620 738 (corresponding to U.S. Pat. No. 4,867,851) and FR 2 821 363.

In order to be able to add powder material into the electrolyte bath, electrolytic cells are equipped with one or several powder material distributors associated with a device for boring the alumina and solidified electrolyte crust that covers the bath surface during normal operation. The boring device usually comprises a jack and a crustbreaker (or "plunger") fixed to the rod of the jack. The plunger is lowered when the jack is actuated and breaks the alumina and solidified bath crust. This operation may be repeated several times and regularly so as to keep the hole through which the powder material is added open. Patent applications FR 1 457 746 (corresponding to GB patent 1 091 373) and FR 2 504 158 (corresponding to U.S. Pat. No. 4,435,255) and U.S. Pat. No. 3,400,062 describe such devices.

However in some conditions, the boring device cannot guarantee that powder material can be added into the bath. In particular, the hole can sometimes get plugged by an alumina block that becomes agglomerated with the solid bath, which hinders the "feed" of powder materials into the bath. The boring device may also be defective. It has been proposed to deal with this type of operation anomaly by making electrical measurements to detect whether or not the plunger is actually in contact with the electrolyte. For example, in patent application FR 2 483 965 (corresponding to U.S. Pat. No. 4,377,452) in the name of Aluminium Pechiney, the contact between the electrolyte and the plunger is detected by an electrical measurement between the crustbreaker and the cathode. If no contact with the electrolyte is detected after a predetermined lapse of time, the system for example gives an order to lift the plunger or stop the feed. This method has the disadvantage that it is sensitive to voltage fluctuations in the cell, particularly during anode effects. American patent U.S. Pat. No. 4,563,255 in the name of Swiss Aluminium describes a similar but more complex solution that uses impedance measurements.

The applicant searched for means of detecting and taking account of operation anomalies in the feed of powder materials to an electrolytic cell that do not depend on electrical measurements made directly on the cell.

SUMMARY OF THE INVENTION

An object of the invention is a method for controlling additions of powder materials into an electrolytic cell designed for the production of aluminium by fused bath electrolysis and provided with at least one powder material distributor and at least one boring device comprising an actuator and a crustbreaker, the said cell containing a liquid electrolyte bath and being operated such that an alumina and solidified bath crust is formed above the liquid electrolyte bath, method in which at least one opening is formed in the said crust using the boring device and powder material is added through at least one opening using a determined procedure for introducing additions in the bath, referred to by the expression "normal feed procedure" and characterized in that:

- at a determined time $t_0$, an electrical signal S is generated to provoke lowering of the crustbreaker using the actuator,
- the moment t at which the crustbreaker reaches a predetermined low position P is measured,
- the value of at least one powder material feed operation indicator is determined, using a function $F(t_0, t)$,
- at least one operation criterion and the value of the operation indicator(s) F are used to determine whether or not operation is abnormal,
- if the operation is not considered to be abnormal, the normal feed procedure is maintained,
- if operation is considered to be abnormal, at least one correction procedure called a "regularisation/normalisation" procedure is triggered, that can restore normal operation of the powder material feed.

Powder materials used are typically an alumina based powder (such as pure or fluorinated powder alumina), aluminium fluoride powder ($AlF_3$) or cryolite based powder (called "powder bath", that may possibly contain alumina and/or several other compounds).

The said feed procedure may apply to additions of several different powder materials.

Another object of the invention is a system for controlling additions of powder materials into an electrolytic cell designed for the production of aluminium by fused bath electrolysis and provided with at least one powder material distributor and at least one boring device comprising an actuator and a crustbreaker, the said cell containing a liquid electrolyte bath and being operated so as to form an alumina and solidified bath crust above the liquid electrolyte bath, characterized in that it comprises:

- a means of generating an electrical signal S capable of causing the crustbreaker to be lowered by means of the actuator at a determined time $t_0$,
- a device for measuring the moment t at which the crustbreaker reaches a determined low position P,
- a means of determining the value of at least one feed operation indicator $F(t_0, t)$ starting from the value of the time $t_0$ and the value obtained for the time t.

The applicant had the idea of using an operation indicator based on the movement of the crustbreaker, and particularly on the crustbreaker travel time between an initial position Po and a determined position P. Such an indicator provides an easy means of getting a simple diagnostic about operation of the feed at a given crustbreaker. The method according to the invention can also maintain monitoring of operation of the feed even during anode effects. It is particularly easy to automate it.

BRIEF DESCRIPTION OF THE DRAWINGS

The invention is described in detail with reference to the attached figures.

DETAILED DESCRIPTION OF PREFERRED EMBODIMENTS

Figure 1:
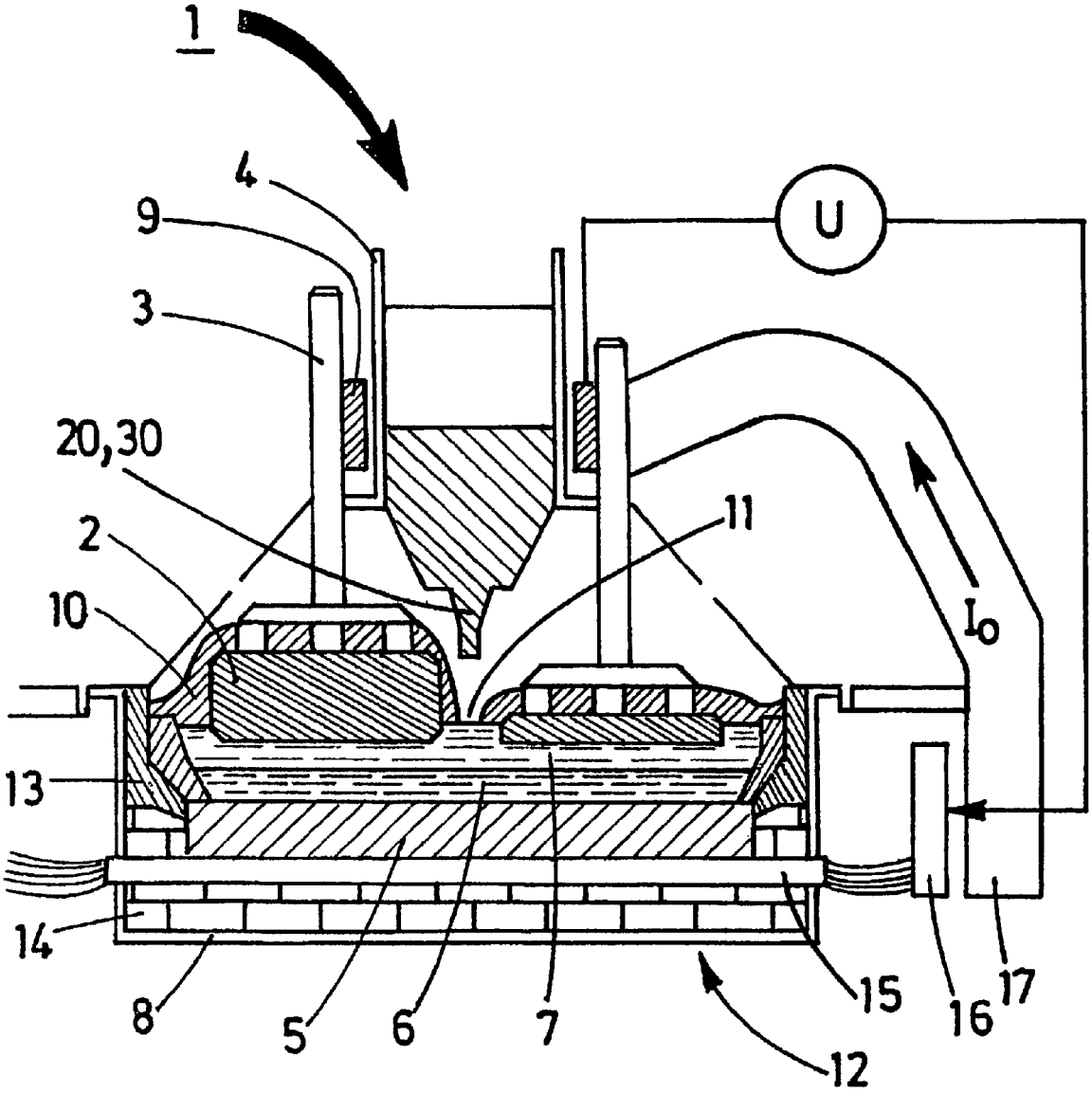
FIG. 1 illustrates a typical electrolytic cell designed for the production of aluminium by fused bath electrolysis, seen in a vertical section.

As shown in FIG. 1, an electrolytic cell (1) for the production of aluminium by fused bath electrolysis, in other words by molten salt electrolysis, comprises a pot (12), anodes (2) and powder material feed means (20, 30). The anodes (2)—typically prebaked anodes made of a carbonaceous material—are supported from an anode beam (9) by a stem (3). The electrolytic pot (12) comprises a metallic shell (8), typically made with steel, internal lining elements (13,14) and a cathode assembly (5, 15). The cathode assembly (5, 15) comprises connection bars (15) called cathode bars, to which electrical conductors (16, 17) used to transfer electrolysis current Io are fixed. The lining elements (13, 14) and the cathode assembly (5, 15) form a crucible inside the pot (12) capable of containing the electrolyte bath (7) and a liquid aluminium pad (6) when the cell is in operation.

Several electrolytic cells are usually arranged in rows and are electrically connected in series using connecting conductors (16, 17). The cells are typically arranged so as to form two or several parallel rows. The electrolysis current Io thus passes in cascade from one cell to the next.

During operation, the anodes (2) are normally partially immersed in the liquid electrolyte bath (7) and the cells are operated so as to form an alumina and solidified bath crust (10) above the electrolyte bath. The electrolysis current Io transits in the electrolyte bath (7) through the anode beam (9), anode stems (3), anodes (2) and cathode elements (5, 15). In general, the aluminium produced by electrolysis of alumina contained in the bath (7) is gradually deposited on the cathode assembly (5) and forms a pad of liquid metal (6).

The normal feed procedure typically comprises the addition of determined quantities of powder material at a constant or variable rate. The quantities, that are typically doses, are usually determined from measurements on the cell, such as temperature measurements, electrical measurements, bath composition analyses and/or measurements of the height of the liquid bath.

An attempt is usually made to control additions of alumina so as to maintain the alumina concentration in the electrolyte within determined limits, typically between an upper limit and a lower limit. Most known industrial processes use an indirect evaluation of the alumina content of the electrolyte bath using an electrical parameter representative of the concentration of alumina in the electrolyte. This parameter is usually an electrical resistance R that is determined starting from a measurement of the voltage U at the terminals of the electrolytic cell and the intensity of the current Io that passes through it. Calibration makes it possible to plot a reference curve of the variation of R as a function of the alumina content and the alumina concentration can be determined at any time by measuring R (at a determined frequency using well known methods). Patent applications FR 2 749 858 (corresponding to U.S. Pat. No. 6,033,550), FR 2 581 660 (corresponding to U.S. Pat. No. 4,654,129) and FR 2 487 386 (corresponding to U.S. Pat. No. 4,431,491) in the name of Aluminium Pechiney describe regulation methods using electrical resistance measurements. These processes use measured values of the resistance R, and particularly the variation of these values, to determine the alumina feed rate to be used at any time.

In general, it is also required to control additions of bath powder, aluminium fluoride or any other compound, so as to maintain a determined bath quantity and specific physical, chemical and electrochemical properties (such as the melting temperature and acidity) within determined limits. Most known industrial processes for bath control make use of bath temperature measurements and/or total earlier additions of bath and aluminium fluoride. Patent applications FR 2 821 363 and FR 2 487 386 (corresponding to U.S. Pat. No. 4,431, 491) in the name of Aluminium Pechiney describe regulation methods using such measurements.

In the context of the invention, the determined procedure for introducing additions in the bath may be any method for regulation of additions of powder materials into the bath of an electrolytic cell, such as those described in the patent mentioned above.

Figure 2:
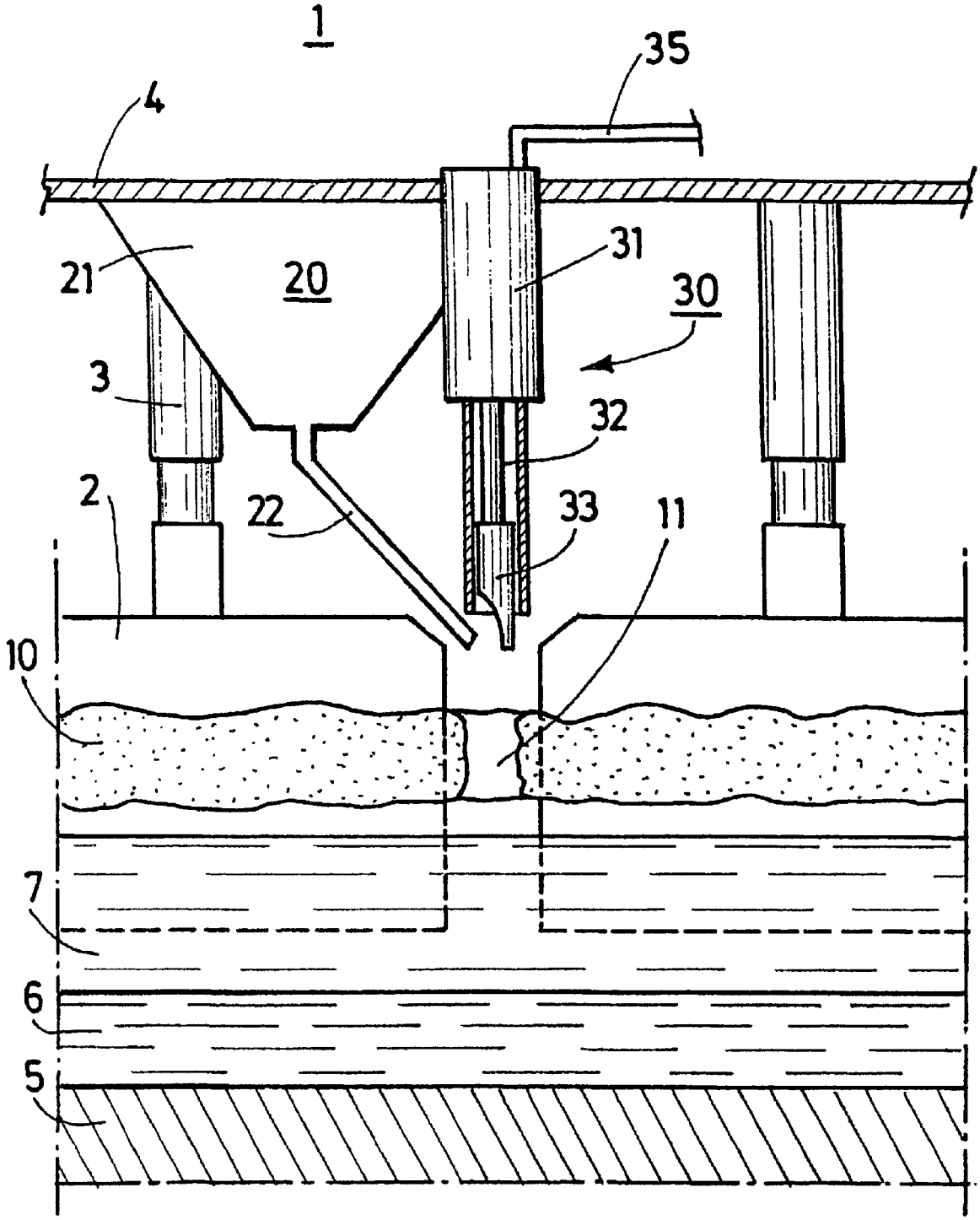
FIG. 2 shows a partial internal view of a typical electrolytic cell intended for the production of aluminium by fused bath electrolysis, seen in a vertical section.

With reference to FIG. 2, the electrolytic cells (1) capable of implementing the control method according to the invention comprise at least one powder material distributor (20) and at least one boring device (30). These elements are usually fixed to a superstructure (4).

The powder material distributor(s) (20) typically comprise a hopper (21) designed to contain a reserve of powder material, and a chute (22) fixed to the lower part of the hopper and that transports the powder material close to an opening (11) in the crust (10).

Each boring device (30) comprises an actuator (31) and a crustbreaker (33) (also called a "plunger") fixed to the end of the actuator rod (32). The actuator (31) is typically a pneumatic actuator such as a pneumatic jack.

A powder material distributor may be associated with one or several determined crustbreaking devices, or conversely a crustbreaking device may be associated with one or several determined powder material distributors. Electrolytic cells are frequently provided with one or several devices including a powder materials distributor and a crustbreaking device; these devices are known under the name of crustbreaking and feeding devices.

During normal operation, at least one opening (11) is formed (or possibly held open) in the said crust (10) between the anodes (2), using one or more boring devices (30) and powder material is added into the electrolyte bath (7) through the opening (11) (or through at least one opening when there are several). In order to achieve this, the rod (32) of the actuator (31) and therefore the crustbreaker (33) has at least one first position called the "waiting position" and at least one second position called the "perforation position". Normally, the first position is a high position and the second position is a low position. Activation of the actuator (31) lowers or raises the rod (32), and therefore the passage of the rod from the first to the second position or vice versa. The dimensions of the device are such that, when the rod is in the first position, the crustbreaker does not hinder the flow of the powder material output from the chute (22), and when the rod is in the second position, the crustbreaker (33) passes through the normal thickness of the said crust (10) to form an opening (11) through which the powder material can be added into an electrolyte bath (7).

Figure 3:
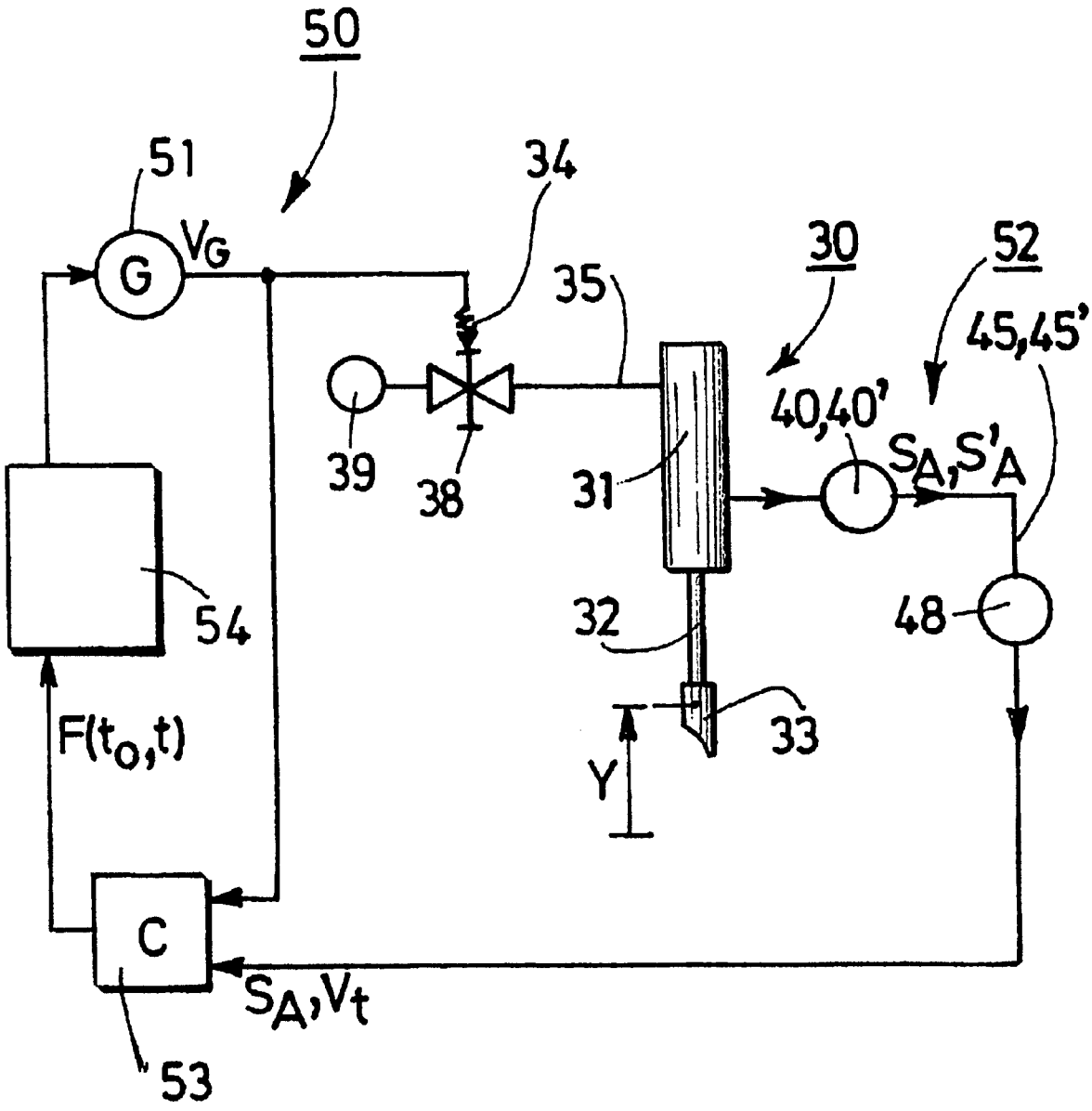
FIG. 3 illustrates a system for controlling additions of powder materials according to the invention.

As shown in FIG. 3, the actuator (31) is activated by a fluid feed (39), usually a compressed air supply, which is controlled using a valve (38), typically a solenoid valve. The actuator (31) is connected to the feed (39) through at least one specific feed duct (35) that typically divides into two close to or at the actuator so that the crustbreaker can be lowered and raised.

In the context of the methods for feeding electrolytic cells with powder material, the invention applies more specifically to the control of the introduction of the said powder materials into the electrolyte bath (7) that depends particularly on the quality of openings (11) in the solidified bath crust (10) and operation of boring devices (30) used to form them and to maintain them. The control method according to the invention may be used intermittently (for example it may be used only when regulation is continuous).

Figure 4:
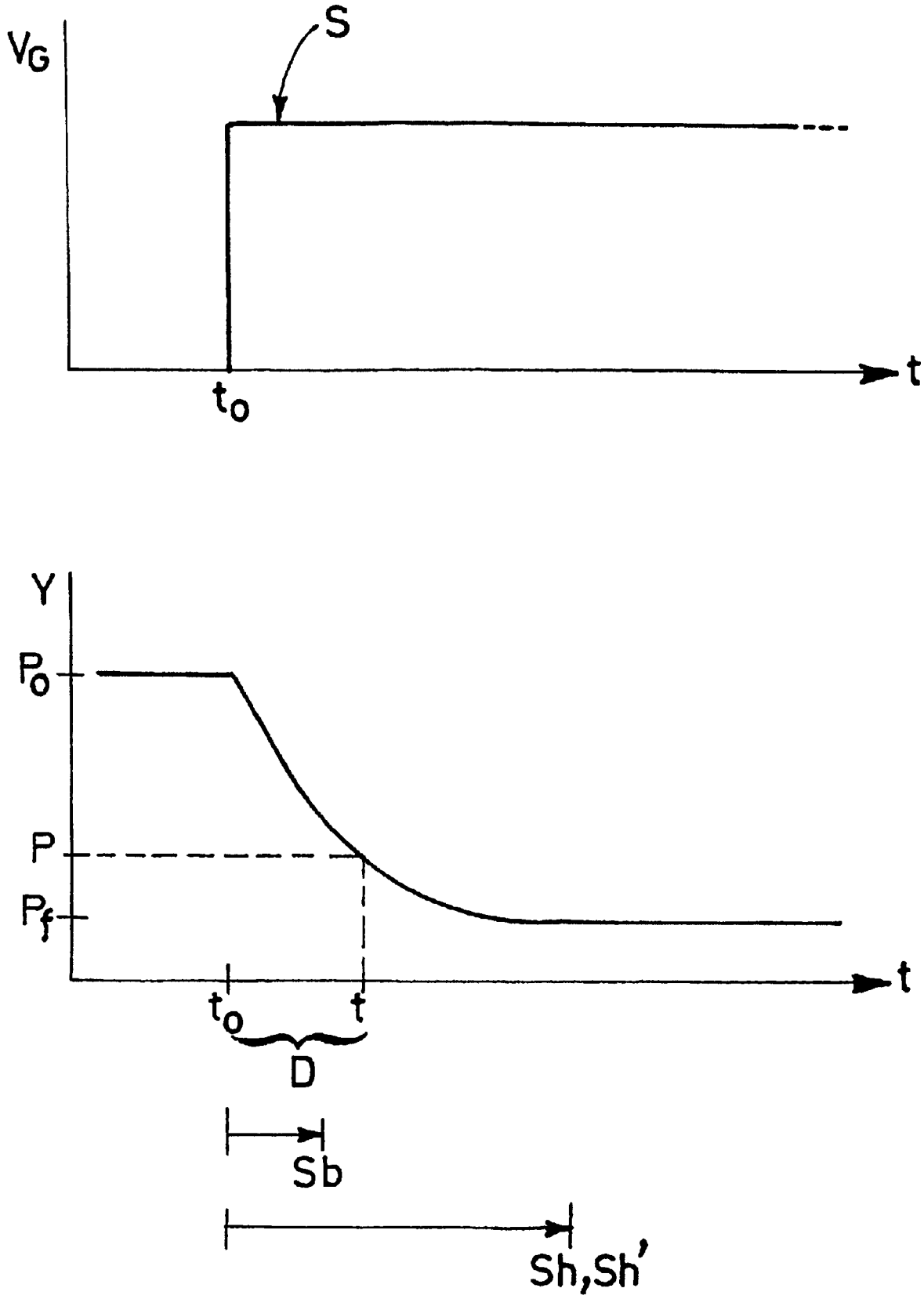
FIG. 4 illustrates operation of the control process according to the invention.

According to the invention, for which operation is shown in FIG. 4, an electrical signal S is generated that will make the actuator (31) lower the crustbreaker (33). This signal is generated at a determined instant $t_0$ that is compatible with the general regulation of the powder material feed. The signal S is typically in step form (as shown in FIG. 4). In reaction to this signal, the crustbreaker (33) is moved by the actuator (31) from an initial position Po to a final position Pf, normally passing through a determined position P called the low position, that may be different from the final position Pf (see FIGS. 4 to 6). According to the invention, the moment t at which the crustbreaker reaches the said determined position P is measured, and the value of at least one feed operation indicator F is determined from the value of $t_0$ and the value obtained for moment t.

The electrical signal S may transmit the crustbreaker lowering order electrically, optically, pneumatically or by any other means, usually through a transmission means (34) diagrammatically shown in FIG. 3.

The determined low position P is typically the position at which the crustbreaker (33) comes into contact with the liquid electrolyte bath (7) or the lowest position allowed by the actuator (31). These positions normally correspond to the said second position, in other words the perforation position.

The initial position Po of the crustbreaker, in other words the position of the crustbreaker (33) at the moment at which the crustbreaker displacement signal S is generated, is typically the said waiting position.

The position of the crustbreaker (33) may be given with respect to a determined reference point Yo.

As shown in FIGS. 3 and 4, the actuator (31) is activated using an electrical signal $V_G$ that acts directly or indirectly on a valve (38), typically a solenoid valve. The electrical signal $V_G$ contains the signal S that will trigger displacement of the crustbreaker. The position of the crustbreaker (33) is measured using at least one position detector (40, 40') that may be integrated into the boring device (30). The position detector or each position detector (40, 40') generates a signal $S_A$ representative of the position of the crustbreaker (33) or specific positions of the crustbreaker (33). The signal $S_A$ may be an electrical, optical or other signal. This signal is then used to determine the moment t at which the crustbreaker reaches the determined low position P.

An operation indicator F may be given simply by a difference function, called the "descent duration" D ($=t-t_0$) between time $t_0$ and time t, in other words $F(t-t_0)$.

In one embodiment of the invention, operation may be considered to be abnormal if the descent duration D is higher than a determined high threshold Sh, in at least Nh successive determinations. The number Nh is typically an integer number between 1 and 10 inclusively.

In one variant of this embodiment of the invention, operation may be considered to be abnormal if the descent duration is found to be longer than a determined threshold Sh' determined in at least Nh' determinations out of N, in other words if the ratio Nh'/N is more than a given value Rh. This is then a "density" of anomalies given by the ratio Nh'/N, that can be expressed as a percentage.

The thresholds Sh and Sh' may be equal to a fixed value or a value calculated using several values for the duration D, that may be successive or separated by intermediate values. For example, Sh may be calculated by the relation Sh=<D>+K, where <D> is a sliding average of the last Mh values of D, where Mh is typically more than 10, and K is a constant designed to avoid the detection of false operation anomalies.

In another embodiment of the invention, operation may be considered to be abnormal if the descent duration is less than a determined low threshold Sb in at least Nb successive determinations. The number Nb is typically an integer number between 1 and 10 inclusively.

In order to increase the response rate of the control method, operation may be considered to be abnormal if the time t cannot be measured after a time T exceeding a maximum determined threshold Tmax. The threshold Tmax is typically between 5 and 15 seconds.

In another embodiment of the invention, an operation indicator called the drift indicator may be determined from a deviation E between at least two values of the duration D, either successive or separated by intermediate values. The said deviation E may be calculated in different ways. For example, the deviation E may be given by the algebraic difference between two successive values of the duration D or two values separated by intermediate values. The deviation E may also be given by a mean deviation or a statistical deviation between at least three successive values of the duration D, or three values separated by intermediate values. Operation is typically considered to be abnormal when the said deviation E is greater than a determined threshold Se.

At least one operation criterion and the value of the operation indicator(s) are used to determine whether or not operation is abnormal. If operation is not considered to be abnormal, the normal feed procedure is kept unchanged; if operation is considered to be abnormal, at least one correction procedure called the "regularisation/normalisation" procedure is triggered to restore the powder material feed to normal operation.

The said regularisation/normalisation procedure typically comprises at least one automatic or manual action to correct operation of the boring device (30). Manual intervention typically comprises maintenance operations. Automatic operation typically comprises successive crustbreaking operations (in other words a series of successive actuations of the actuator (31) at short time intervals), or an increase in the fluid pressure injected into the actuator (31) or an adaptation of the pressure applied by the actuator (31) to the value of time t (and more precisely the descent duration D of the crustbreaker (33)).

In one advantageous embodiment of the invention, the electrolytic cell (1) comprises at least two boring devices (30) each associated with a distinct powder material distributor (20) and the regularisation/normalisation procedure includes an at least temporary interruption of the feed by the distributor associated with the boring device for which operation is considered to be abnormal. The corresponding powder material feed is then advantageously distributed on the other distributor(s) in the cell.

Advantageously, when operation of at least one boring device (30) is considered to be abnormal, the control method may also comprise a modification of the normal feed procedure.

The invention is advantageously used using a system (50) for controlling the feed of powder materials comprising:

- a means (51) of generating an electrical signal S capable of provoking lowering of the crustbreaker (33) using an actuator (31), at a determined time $t_0$,
- a device (52) for measuring the time t at which the crustbreaker (33) reaches a predetermined low position P,
- a means (53) called the "diagnostic means" to determine the value of at least one feed operation indicator $F(t_0,t)$ starting from the value of the time $t_0$ and the value obtained for time t.

The measurement device (52) typically comprises at least one position detector (40) capable of detecting the said low position P. The position detector (40) is advantageously capable of producing a signal $S_A$ at the moment t at which the crustbreaker (33) reaches the determined low position P. The device may possibly also comprise a converter (48) to generate a specific electrical signal $V_t$ starting from the signal $S_A$.

The position detector (40) may be integrated into the boring device(s) (30), particularly into the said actuator(s) (31), in other words the boring device or each boring device (30) may comprise at least one position detector (40) capable of detecting the said low position. Thus, an actuator (31) that could be used to implement the invention advantageously comprises at least one position detector (40) capable of detecting at least the said low position P of the actuator rod (32). For example, the actuator (31) of the boring device or each boring device (30) may comprise a jack fitted with the said position detector (40). For example, the detector (40) may be a stroke end detector.

The position detector(s) (40) may be chosen from among mechanical, electrical, optical or magnetic detectors, and detectors comprising any combination of these means.

The measurement device (52) may comprise at least one complementary position detector (40') that may be integrated into the boring device(s) (30). For example, it may comprise a detector (40') capable of detecting a waiting position Po of the actuator rod (32).

Figure 5:
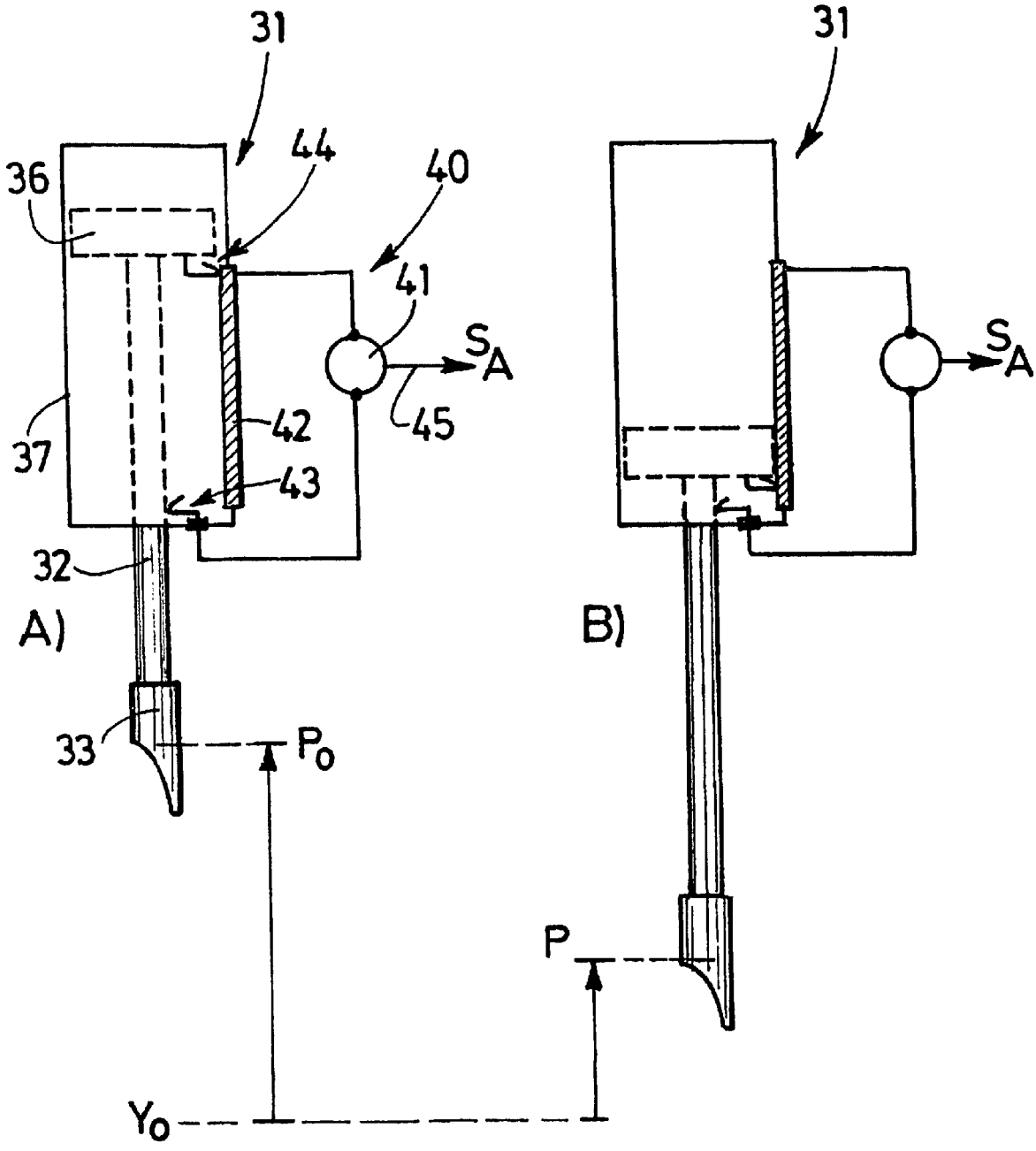
FIGS. 5 and 6 illustrate the structure and operation of a boring device that could be used to implement the invention.
Figure 6:
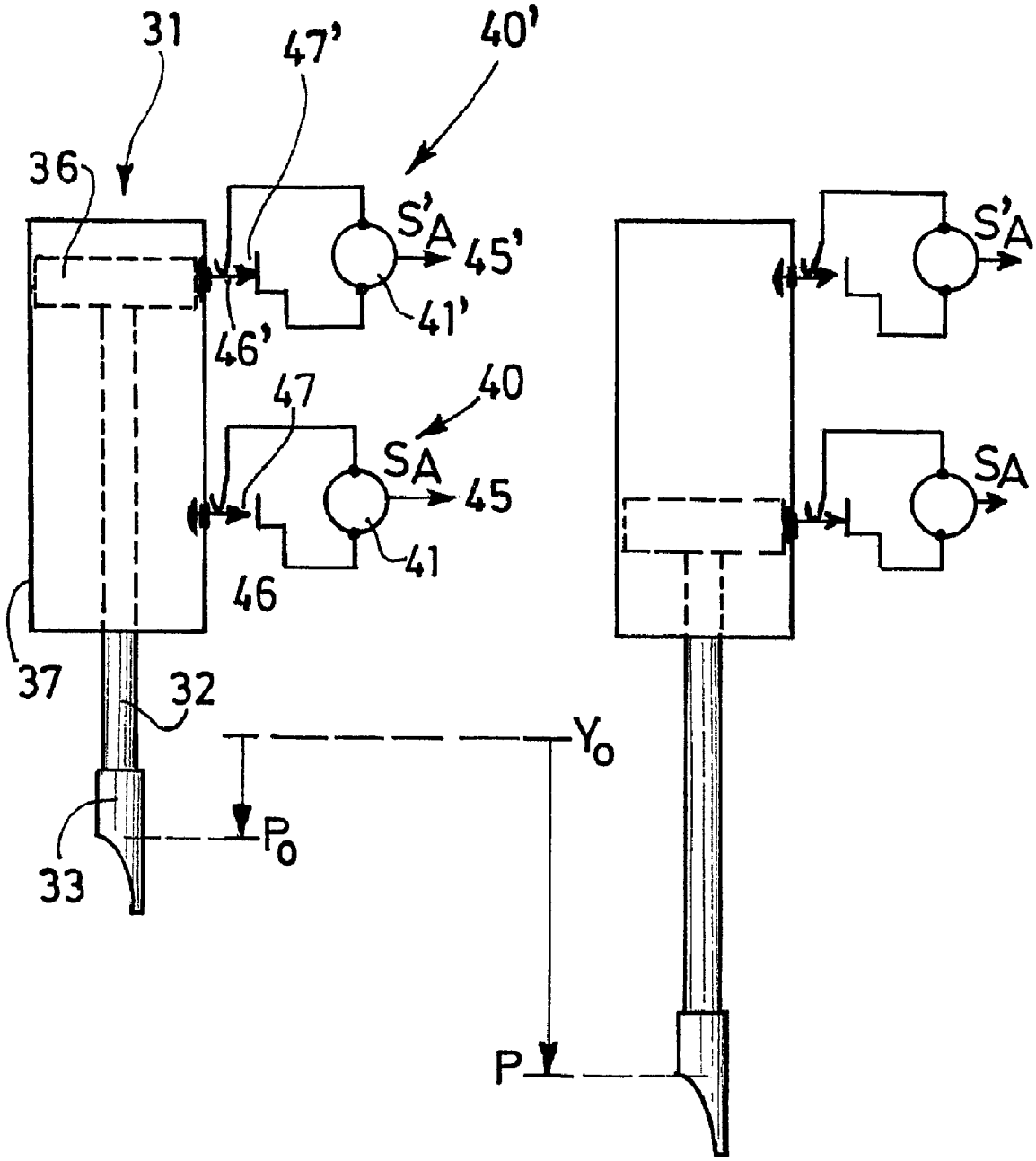

FIGS. 5 and 6 illustrate actuators (31) that could be used to implement the invention. The actuators (31) are typically connected to a signal converter (41, 41') (such as a multimetre) and a signal carrier (45, 45') (such as an electrical cable, an electromagnetic wave or an optical beam), designed to transmit information about the position of the crustbreaker (33), possibly through a converter (48) capable of generating the signal $V_t$, to the diagnostic means (53).

In the case shown in FIG. 5, the actuator (31) comprises a continuous position detector (40). For example, this detector may comprise a resistance (42), a first friction contact (43) (typically fixed to the body of the actuator (37)), a second friction contact (44) (typically fixed to the rod (32) or the piston (36) of the actuator) and a multimetre (41).

In the case shown in FIG. 6, the actuator (31) comprises two discontinuous position detectors (40, 40') capable of detecting specific positions of the actuator rod (32) and therefore the crustbreaker (33). For example, each position detector (40, 40') may comprise a distinct electromechanical system. Each system comprises a rod (46, 46') and an opening contact (47, 47') that are actuated by passage of the piston (36) in the inner part of the rod.

For example, the diagnostic means (53) may be a computer or a comparator C. As shown in FIG. 3, the means (53) typically uses the signal $S_A$ or $V_t$ containing information about the time t generated by the position detector and the signal $V_G$ containing the associated signal S at time $t_0$.

The control system (50) according to the invention typically comprises a regulator (54) that may be integrated into the general regulation system of the electrolytic cell (1), that is not shown. Normally, the regulator (54) controls the electrical signal generator (51). The regulator (54) advantageously comprises specific means of implementing the automatic actions intended to correct operation of a boring device (30) when an operation indicator $F(t_0, t)$ reveals abnormal operation of the feed. In particular, the regulator (54) may be provided with a computer program for control of automatic actions (for example, this program may generate a series of successive signals to activate the actuator (31) at close time intervals, in order to cause successive crustbreaking operations). The regulator (54) may also comprise means of controlling the pressure of the fluid injected into the actuator(s) (31) of the boring device(s) (30), in order to implement an automatic action including a change to the said pressure.

The method and system according to the invention may be used to detect abnormal operation of an electrolytic cell or a series of electrolytic cells.

The invention improves the reliability of the powder material feed to electrolytic cells.

The invention claimed is:

1. A method for controlling additions of powder materials into an electrolytic cell designed for the production of aluminium by fused bath electrolysis and provided with at least one boring device comprising an actuator and a crustbreaker, the actuator comprising a piston connected to a piston rod, the piston rod being connected to the crustbreaker, said cell containing a liquid electrolyte bath and being operated such that an alumina and solidified bath crust is formed above the liquid electrolyte bath, the method comprising:

generating an electrical signal to provoke lowering of the crustbreaker using the actuator, measuring the moment at which the crustbreaker reaches a predetermined low position, using at least one position detector capable of detecting a position of a component of the actuator selected from the group consisting of the piston and the piston rod, determining the value of at least one powder material feed operation indicator, based on the measured moment, using a function, using at least one operation criterion and the value of the operation indicator to determine whether an operation is abnormal, if the operation is not considered to be abnormal, maintaining a determined procedure for feeding a powder material into the bath through an opening created by the crustbreaker, and if operation is considered to be abnormal, triggering at least one correction procedure that can correct the abnormal operation.

2. A control method according to claim 1, wherein the operation indicator is given by a descent duration D that is equal to a function of the difference between a time $t_0$ and a time t.

3. A control method according to claim 2, wherein operation is considered to be abnormal if the descent duration D is higher than a determined high threshold Sh, in at least Nh successive determinations.

4. A control method according to claim 3, wherein Nh is an integer number from 1 to 10 inclusively.

5. A control method according to claim 2, wherein operation is considered to be abnormal if the descent duration is longer than a determined threshold Sh' determined in at least Nh' determinations out of N, such that the ratio Nh'/N is more than a given value Rh.

6. A control method according to claim 5, wherein the threshold Sh' are equal to a fixed value or a value calculated using several values for the duration D, that are successive or separated by intermediate values.

7. A control method according to claim 2, wherein operation is considered to be abnormal if the descent duration is less than a determined low threshold Sb in at least Nb successive determinations.

8. A control method according to claim 7, wherein Nb is an integer number from 1 to 10 inclusively.

9. A control method according to claim 2, wherein operation is considered to be abnormal if time t cannot be measured after a time T exceeding a maximum determined threshold Tmax.

10. A control method according to claim 9, wherein the threshold Tmax is from 5 to 15 seconds.

11. A control method according to claim 1, wherein the operation indicator is determined from a deviation E between at least two values of the duration D, either successive or separated by intermediate values.

12. A control method according to claim 11, wherein said deviation E is given by an algebraic difference between two successive values of the duration D or two values separated by intermediate values.

13. A control method according to claim 11, wherein said deviation E is given by a mean deviation or a statistical deviation between at least three successive values of the duration D, or three values separated by intermediate values.

14. A control method according to claim 11, wherein operation is considered to be abnormal when said deviation E is greater than a determined threshold Se.

15. A control method according to claim 1, wherein said correction procedure comprises at least one automatic or manual action to correct operation of the boring device.

16. A control method according to claim 1, wherein the cell comprises at least two boring devices each associated with a distinct powder material distributor for feeding powder material into the bath, and further wherein the correction procedure includes an at least temporary interruption of the feed by the distributor associated with the boring device for which operation is considered to be abnormal.

17. A control method according to claim 16, wherein said correction procedure comprises distributing the feed of powder material on another distributor in the cell.

18. A control method according to claim 1, wherein when operation of at least one boring device is considered to be abnormal, the control method also comprises a modification of the determined procedure.

19. A control method according to claim 1, wherein the predetermined low position is a position at which the crustbreaker comes into contact with the liquid electrolyte bath.

20. A control method according to claim 1, wherein the predetermined low position is a lowest position allowed by the actuator.

21. A control method according to claim 1, wherein the at least one boring device comprises at least one jack fitted with said position detector.

22. A control method according to claim 21, wherein said detector is a stroke end detector.

23. A control method according to claim 1, wherein the position detector is at least one selected from the group consisting of mechanical detectors, electrical detectors, optical detectors, magnetic detectors, and detectors comprising any combination thereof.

24. A control method according to claim 1, wherein the electrical signal transmits an order to lower the crustbreaker, the order being transmitted in at least one way selected from the group consisting of: electrically, optically, and pneumatically.

25. A control method according to claim 1, wherein said powder materials are selected from the group consisting of: alumina based powders, aluminium fluoride powders and cryolite based powders, and combinations thereof.

26. A control system for controlling additions of powder materials into an electrolytic cell designed for the production of aluminium by fused bath electrolysis and provided with at least one powder material distributor and at least one boring device comprising an actuator and a crustbreaker, the actuator comprising a piston connected to a piston rod, the piston rod being connected to the crustbreaker, said cell containing a liquid electrolyte bath and being operated so as to form an alumina and solidified bath crust above a liquid electrolyte bath, wherein said system comprises:

a means for generating an electrical signal capable of causing the crustbreaker to be lowered by the actuator at a determined time $t_0$, a device for measuring the moment t at which the crustbreaker reaches a predetermined low position, said device comprising at least one position detector capable of detecting a position of a component of the actuator selected from the group consisting of the piston and the piston rod, and a diagnostic means for determining the value of at least one feed operation indicator starting from a value of time $t_0$ and a value obtained for time t.

27. A control system according to claim 26, wherein said detector is integrated into the at least one boring device.

28. A control system according to claim 27, wherein said detector is integrated into said actuator in each boring device.

29. A control system according to claim 28, wherein the actuator comprises a jack fitted with said detector.

30. A control system according to claim 26, wherein said detector is a stroke end detector.

31. A control system according to claim 26, wherein the detector is at least one selected from the group consisting of mechanical detector, electrical detector, optical detector, magnetic detectors, and detectors comprising any combination thereof.

32. A control system according to claim 26, wherein the control system comprises a regulator.

33. A control system according to claim 32, wherein the regulator comprises means for implementing automatic actions intended to correct operation of said boring device when the operation indicator reveals abnormal operation of the feed.

34. A control system according to claim 26, wherein said powder materials are selected from the group consisting of: alumina based powders, aluminium fluoride powders and cryolite based powders, and combinations thereof.

35. A control method according to claim 3, wherein the threshold Sh are equal to a fixed value or a value calculated using several values for the duration D, that are successive or separated by intermediate values.

36. A method for operating an electrolytic cell containing a liquid electrolyte bath having a solidified crust formed thereon, the cell having a boring device and a powder material distributor associated therewith, the boring device comprising an actuator having a crustbreaker connected thereto such that the actuator is configured to move the crustbreaker, the method comprising:

generating an electrical signal configured to cause the actuator to lower the crustbreaker toward the electrolyte bath;

measuring a descent duration for the crustbreaker to reach a predetermined low position;

determining, based on the descent duration, whether an operation of the electrolytic cell is abnormal;

if the operation is not determined to be abnormal, maintaining a normal procedure for feeding a powder material into the bath by the powder material distributor through an opening created by the crustbreaker; and if the operation is determined to be abnormal, triggering at least one correction procedure for correcting the abnormal operation.

37. A method according to claim 36, wherein the operation is an operation of at least one of the boring device and the powder material distributor.

38. A method according to claim 36, wherein the operation is determined to be abnormal if the descent duration is higher than a determined high threshold Sh, in at least Nh successive determinations.

39. A method according to claim 36, wherein the operation is determined to be abnormal if the descent duration is less than a determined low threshold Sb in at least Nb successive determinations.

40. A method according to claim 36, wherein the operation is determined to be abnormal if the descent duration cannot be measured after passage of a threshold time period.

41. A method according to claim 36, wherein the crustbreaker reaching the predetermined low position is detected by a position detector associated with the boring device and capable of detecting a position of a component of the actuator.

42. A method according to claim 41, wherein the actuator comprises a piston connected to a piston rod, the piston rod being connected to the crustbreaker, wherein the component of the actuator detected by the position detector is selected from the group consisting of the piston and the piston rod.

43. A method according to claim 36, wherein the cell comprises at least two boring devices, each associated with a distinct powder material distributor for feeding powder material into the bath, and further wherein the correction procedure includes an at least temporary interruption of the feed by the powder material distributor associated with the abnormal operation.

* * * * *